US005797242A

United States Patent [19]

Sauer

[11] Patent Number: 5,797,242

[45] Date of Patent: Aug. 25, 1998

[54] PRODUCTION OF AN ENDLESS BAND AND METHOD AND BANDING APPARATUS FOR BANDING WITH THIS ENDLESS BAND

[75] Inventor: Hartmut Karl Sauer, Himmelstadt, Germany

[73] Assignee: De La Rue Giori S.A., Switzerland

[21] Appl. No.: 657,395

[22] Filed: Jun. 3, 1996

[30] Foreign Application Priority Data

Jun. 9, 1995 [CH] Switzerland ..... 01 705/95

[51] Int. Cl.[6] ..... B65B 13/04; B65B 57/00

[52] U.S. Cl. ..... 53/399; 53/589; 53/51; 428/343; 156/191; 100/4; 100/26

[58] Field of Search ..... 53/399, 589, 51; 100/25, 26, 4; 156/191; 428/343, 349

[56] References Cited

U.S. PATENT DOCUMENTS

| | | | |
|---|---|---|---|
| 2,170,147 | 8/1939 | Lane | 53/399 X |
| 3,648,835 | 3/1972 | Yucel | 428/343 |
| 3,667,352 | 6/1972 | Helmig et al. | 53/51 X |
| 3,996,719 | 12/1976 | Dabrowski et al. . | |
| 4,744,202 | 5/1988 | Wylie | 53/51 X |
| 4,776,905 | 10/1988 | Cheung et al. | 53/399 X |
| 5,221,393 | 6/1993 | Heutschi | 428/349 |
| 5,560,180 | 10/1996 | Rodriguez et al. | 53/399 |
| 5,585,178 | 12/1996 | Calhoun et al. | 428/343 |

FOREIGN PATENT DOCUMENTS

| | | |
|---|---|---|
| 0 612 661 A1 | 8/1994 | European Pat. Off. . |
| 25 01 734 A1 | 7/1976 | Germany . |
| 39 37 970 A1 | 5/1991 | Germany . |

*Primary Examiner*—Linda Johnson
*Attorney, Agent, or Firm*—Kane, Dalsimer, Sullivan, Kurucz, Levy, Eisele and Richard, LLP

[57] ABSTRACT

The endless band is provided with print marks (D) at equal distances, this distance (r) corresponding to the circumference of the largest pack goods item (P) to be banded, plus an overlap. A strip-shaped glue coat (L) for closing the band loops (*5a*) is applied transversely to the longitudinal direction of the band at a constant predetermined distance (s) in front of each print mark (D). During banding, after the looping of the pack goods (P) the band movement is stopped when a print mark (D) is read by a print mark reader. At standstill, a glue coat (L) is located directly at the closing mechanism. While the free band end is retained, the endless band is retracted until the band loop (*5a*) surrounds the pack goods (P) with a specific tension. The closing of the band loop and the severance of the latter then take place. When the circumference of a pack goods item is smaller than that of the largest pack goods item, the excess length (2x) remaining in front of the following glue coat (L) after the band loop has been severed is also banded in as an inner overlap (2x) during the banding of the following pack goods item.

3 Claims, 2 Drawing Sheets

Pa
Pb
Pc
Pd
Pe
Pf
D
H
B
x
y
z
2x
2y
2z

L
r
s
5a
5b
5c
5d
5e
5f

PRODUCTION OF AN ENDLESS BAND AND METHOD AND BANDING APPARATUS FOR BANDING WITH THIS ENDLESS BAND

FIELD OF THE INVENTION

The invention relates to the production of an endless band for the automatic banding of pack goods and to a method and a banding apparatus for banding with this endless band.

PRIOR ART

So that hitherto known endless bands unwound from a band roll can be used for the banding of pack goods of differing height and the band loops can be fastened with a specific pretension around the pack goods, at least one side of the endless band must be fully coated or covered with glue. In the case of ultrasonic welding of the band ends, this coating must even be present on both sides.

SUMMARY OF THE INVENTION

The object on which the present invention is based is to provide an endless band for the banding of pack goods of differing height, in which there is no need for one side to be coated, especially covered with glue, completely, so that, on the one hand, coating material, especially glue, is saved and, on the other hand, harm to the environment is reduced as a result of this saving.

At the same time, a further object of the invention is to provide a method and a banding apparatus for the banding of pack goods of differing height with an endless band of this type.

BRIEF DESCRIPTION OF THE DRAWINGS

The invention is explained in more detail by means of the drawings with reference to an exemplary embodiment.

DESCRIPTION OF THE PREFERRED EMBODIMENT(S)

Figure 1:
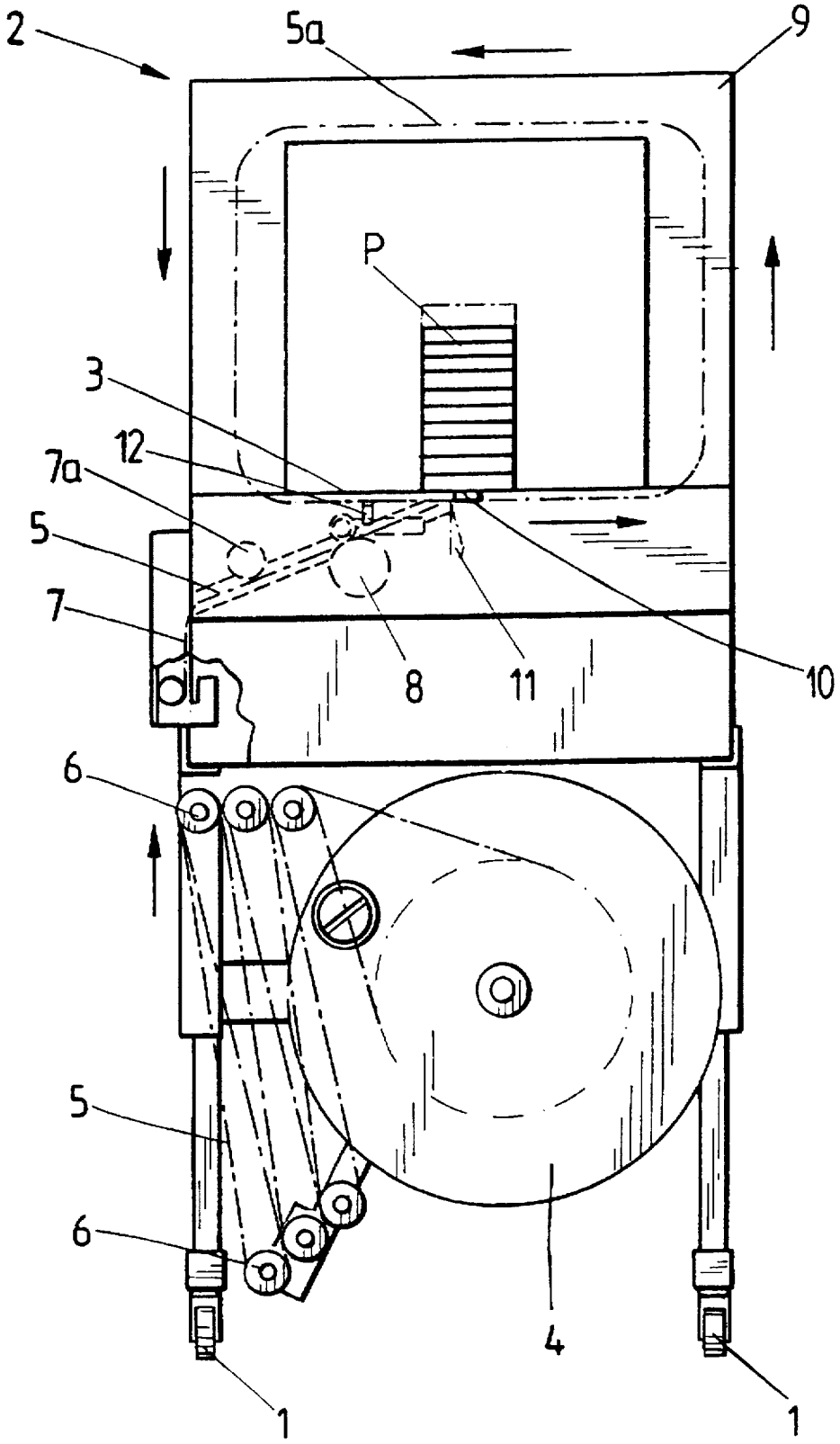
FIG. 1 shows a diagrammatic side view of a banding apparatus according to the invention.

The banding apparatus represented in FIG. 1 is accommodated in a stand 2 movable on rollers 1 and has an upper part, in which a horizontal plate 3 for the pack goods P is provided and the actual banding device is installed, and a lower part, in which the band roll 4 and a system of tension and guide rollers 6 for the band 5 in the form of an endless band, unwound from the roll 4 in the direction of the arrows and running through the roller system 6, are installed.

The endless band 5 is provided with strip-shaped print marks D at equal constant distances r, the width of which is, for example, 5 mm (FIGS. 3*a* to 3*f*). This constant distance r between adjacent print marks is equal to the repeat length of the band (FIG. 3*c*) which corresponds to the circumference of the largest pack goods item to be banded plus an overlap sufficient for adhesive bonding. The repeat length is therefore equal to 2x (maximum height H and maximum width B) of the pack goods plus overlap (FIG. 2*a*). Moreover, the endless band 5 is provided at a predetermined constant distance s in front of each print mark D, as seen in the feed direction of the band, with a strip-shaped glue coat L running transversely to the longitudinal direction of the band (FIGS. 3*a* to 3*f*). The width of this glue coat corresponds to the width of the closure.

The actual banding device includes a band entry 7 and a guide roller 7*a*, which are mounted laterally on the stand underneath the plate 3, a motor 8, likewise installed underneath the plate 3, for driving the band 5 in the forward or reverse direction, a known looping mechanism, not shown in more detail, with a band guide 9 for forming a band loop 5*a* around the pack goods P, and, underneath the plate 3, a closing mechanism 10 in the form of a heating ram and a knife 11.

Moreover, a print mark reader 12 is fixedly installed in the stand 1 at a specific distance from the closing mechanism 10 and from the knife 11, in such a way that the endless band 5, after being looped around the pack goods P, is guided past this print mark reader 12 which, when it reads a print mark D, by means of a corresponding signal causes the endless band to stop in a position in which a glue coat L is located directly at the closing mechanism 10.

Banding takes place in the following way: the pack goods P to be banded, in the example under consideration a stack consisting of a plurality of banknote bundles, are transported onto the plate 3 into the banding position which is located approximately in the middle of the plate 3, as shown in FIG. 1. Then, by means of the motor 8, the endless band 5 is moved forward in the direction of the arrows and, at the same time, pushed with its free end underneath the pack goods P through slots in the plate 3 into the band guide 9, the endless band 5 being unwound from the band reel 4 and, after passing the roller system 6, being drawn through the band entry 7. The free band end is looped around the pack goods P at a distance by the band guide 9 in the direction of the arrows, to form a loop 5*a*, and is guided under the pack goods P via the print mark reader 12. As soon as the print mark reader 12 responds when a print mark D passes, the motor 8 and consequently the band movement are stopped. When the endless band is at a standstill, the glue coat L, which is at the distance s in front of the print mark D, is located on the outside of the free end of the loop 5*a*, that is to say on the underside of the loop end and directly above the closing mechanism 10 in the illustration according to FIGS. 1, 2*a* to 2*f*.

The end of the loop 5*a* is then retained by means of a gripper not shown; the band guide 9 designed in the form of a guide frame is adjusted by means of an appropriately controlled actuating member, in such a way that the loop 5*a* is released, and, by means of the motor 8 then controlled in the reverse direction, the endless band 5 is retracted until the loop 5*a* loops around the pack goods P with a specific tension. During the tensioning of the loop 5*a*, the endless band 5 is wound back onto the band roll 4 correspondingly.

The closing mechanism 10 is then actuated, by means of which the band loop is closed by heat sealing, in that the outer band portion covering the glue coat L at the band end is pressed against this glue coat; and finally, the loop is severed behind the band closure by the cutting knife 11 which is arranged directly behind the closing mechanism, so that cutting off takes place immediately behind the closure. The pack goods 2 are subsequently conveyed further, and the following pack goods are transported into the banding position.

The sequence of the banding operations for pack goods of differing height is explained in more detail in FIGS. 2*a* to 2*f* and 3*a* to 3*f*. According to FIGS. 2*a* to 2*f*, in which each pack goods item is represented as a stack consisting of a plurality of sheet bundles, especially banknote bundles, the pack goods item Pa to be banded first has the maximum possible dimensions, that is to say the maximum height H and the width B constant for each pack goods item. The pack goods item Pb to be banded thereafter has a height reduced by the amount x, this then being followed by the pack goods item Pc, which again has the maximum height H, the pack goods item Pd with a height reduced by the amount y in relation to the maximum height, the pack goods item Pe with a height reduced by the greater amount z, and finally the pack goods item Pf, again with the maximum height H.

The pack goods item Pa (FIG. 2*a*) receives the band loop 5*a* (FIG. 3*a*), the free end of which coincides, in the example under consideration, with the front edge of the glue coat L and the length of which is matched exactly to the pack goods circumference, since, of course, the repeat length r corresponds to this maximum pack goods circumference. The new free end of the endless band 5 once again commences directly at the following glue coat L. This band loop 5*a* consequently has no excess length which projects beyond the glue coat L on the inside of the band closure. The outer overlap is only just large enough to ensure that it is sufficient for closing the band securely.

The following pack goods item Pb receives the band loop 5*b* (FIG. 3*b*), the length of which is smaller by the amount 2x on account of the lower height of the pack goods item Pb. This means that, after the loop 5*b* has been severed, the new free end of the endless band is not located at the front edge of the following glue coat L, but at the distance 2x in front of it.

Figures 2A, 2B, 2C, 2D, 2E, 2F, 3A, 3B, 3C, 3D, 3E, 3F:
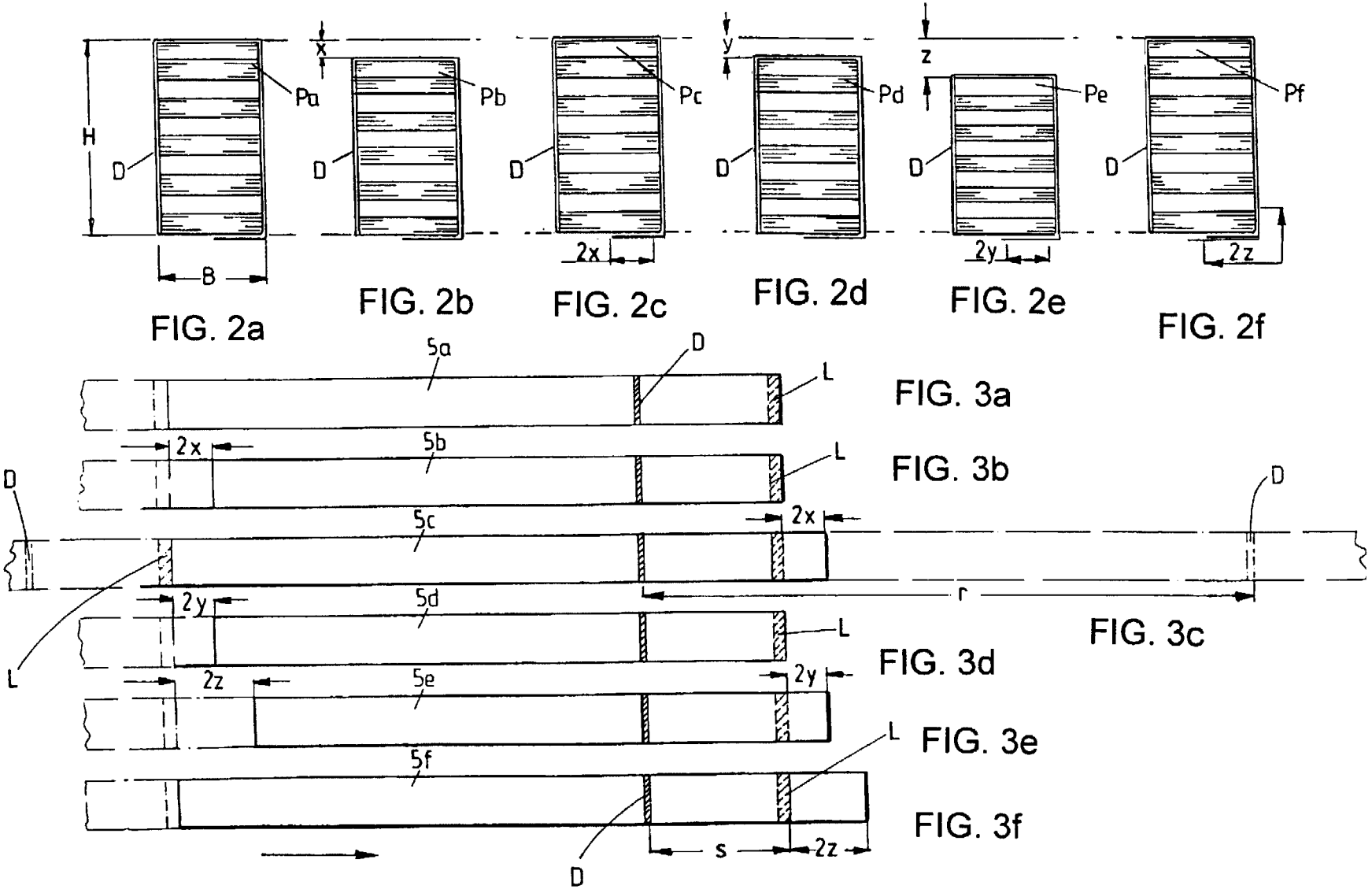
FIGS. 2*a* to 2*f* and FIGS. 3*a* to 3*f* illustrate the sequence of the banding operations in the case of pack goods of differing height.

The result of this is that, after the banding of the following pack goods item Pc, which again has the maximum height H, the band loop 5*c* surrounding this pack goods item has, in front of the closure point, an excess length 2x in the form of an inner overlap, as shown in FIG. 2*c*. The band loop 5*c* surrounding this pack goods item Pc is therefore longer than the repeat length r by the amount 2x, the excess length 2x also being banded in as a projecting piece.

The following pack goods item Pd, which again has a lower height, receives a band loop 5*d* (FIG. 3*d*) which is smaller than the repeat length r by the amount 2y, but has no excess length at the inner end.

The following pack goods item Pe (FIG. 2*e*) has a height which is lower than the maximum height H by the amount z. The result of this is that, on the one hand, the amount 2y originating from the preceding banding operation has remained as an excess length in front of the glue coat or the closure as an inner overlap and has been banded in, and that, on the other hand, the severance of this band loop has taken place by the amount 2z in front of the following glue coat.

The following pack goods item Pf, which again has the maximum height H, accordingly has a band loop 5*f* (FIG. 3*f*) which possesses, in front of the glue coat or the closure, an inner banded-in overlap with the length 2z which, in the instance under consideration, is bent around the lower right-hand corner of the pack goods item Pf.

The essential idea is, therefore, that, when a pack goods item having a lower height than the maximum height occurs, the excess length present during the banding of the following pack goods item is left at the start of the following band loop as an inner band overlap and is also banded in, but the outer end of the closed loop is always severed immediately behind the closure, so that there is no visible excess length. It is thereby sufficient to apply the glue coat L merely in the form of a narrow strip on the endless band at distances corresponding to the repeat length. The inner overlap in the case of a smaller pack goods item occurs automatically, in that the print mark D, which is read by the print mark reader and the position of which determines the stopping and consequently the closing and cutting points of the band, is always at the same distance s from the glue coat L and the distance of the print mark reader from the closing mechanism and from the knife is defined correspondingly. This distance is therefore as it were transmitted to the band. The glue coat is consequently always located at the same point on the pack goods item.

The invention is not restricted to the exemplary embodiment described, but permits many variations in terms of the design of the banding apparatus. Instead of a glue coat, a coating capable of being welded ultrasonically can also be provided.

I claim:

1. An endless band (5) for the automatic banding of pack goods (P), the endless band (5) having a repeat length and being provided with print marks (D) at equal distances, this distance between adjacent print marks (D) being equal to the repeat length (r) of the band, the repeat length (r) of the band corresponding to the circumference of the largest pack goods item to be banded, plus an overlap, and a strip-shaped glue coating (L) for closing the band loops (5*a* to 5*f*) being applied transversely to the longitudinal direction of the endless band (5) at a constant predetermined distance (s) in front of each print mark (D).

2. A method for the banding of pack goods (P) of differing height with an endless band (5) according to claim 1, said method comprising, looping of the pack goods (P), guiding the band loop (5*a* to 5*f*) past a print mark reader (12) for responding to a print mark (D) and, when the latter responds to a print mark (D), the band loop is stopped, in such a way that the glue coat (L) located in front of the print mark (D) is located directly at a closing mechanism (10), retaining the free end of the band loop and retracting the endless band until the loop surrounds the pack goods with a predetermined tension actuating the closing mechanism (10) and severing the loop behind the closure by a cutting knife, (11), whereupon the next pack goods item is banded with the following band loop in the same way, and wherein, in the event that the circumference of the preceding pack goods item was smaller than the repeat length (r) of the band, the remaining excess length (2x, 2y, 2z) between the cutting point and the following coating (L) is also banded in as a projecting piece.

3. A banding apparatus for banding with an endless band (5) according to claim 1, said apparatus comprising a motor means (8), controllable in the forward and reverse direction, for driving the endless band (5), a fixed print mark reader (12), a fixed closing mechanism (10) and a fixed cutting knife (11) being installed on this apparatus, the print mark reader (12) being positioned in such a way that the band, after looping around a pack goods item (P), runs past the latter, the print mark reader being operable to stop the motor (8) after reading the print mark, and the distance of the print mark reader (12) from the closing mechanism (10) and from the cutting knife (11) being related to the distance (s) between a print mark (D) and the preceding coating (L) on the endless band.

* * * * *